United States Patent [19]

Hoshide

[11] 4,044,538

[45] Aug. 30, 1977

[54] ARRANGEMENT OF STRAND TWISTING APPARATUSES

[75] Inventor: Itsuo Hoshide, Iwakuni, Japan

[73] Assignee: Teijin Seiki Company Limited, Osaka, Japan

[21] Appl. No.: 762,123

[22] Filed: Jan. 24, 1977

[51] Int. Cl.[2] ..... D07B 3/00

[52] U.S. Cl. ..... 57/62

[58] Field of Search ..... 57/34 R, 58.49, 58.52, 57/58.57, 58.59, 58.7, 58.83, 58.86, 59, 60, 62, 63, 64

[56] References Cited

U.S. PATENT DOCUMENTS

| | | | |
|---|---|---|---|
| 868,726 | 12/1906 | Tobey | 57/64 |
| 2,920,437 | 1/1960 | Stark | 57/59 X |
| 3,238,711 | 3/1966 | Lundgren | 57/58.52 |
| 3,732,682 | 5/1973 | Crotty et al. | 57/62 X |
| 3,771,304 | 11/1973 | Taketomi et al. | 57/58.59 X |
| 3,824,775 | 7/1974 | Birch | 57/58.52 |

*Primary Examiner*—Donald Watkins

[57] ABSTRACT

Herein disclosed is an arrangement of strand twisting apparatuses, comprising a plurality of strand twisting apparatuses which are side-by-side and vertically installed in a row on floor, and each of which comprises a fore portion of a frame including a flyer unit vertically disposed for supplying and twisting strands into a cable, a take-up unit disposed in side-by-side relation with the flyer unit to wind the cable, a direction change roll unit disposed immediately above the flyer unit for changing the cable vertically fed from the flyer unit to a horizontal direction, a capstan roll unit disposed immediately above the take-up unit for smooth feed of the cable fed from the direction change roll unit to the take-up unit, and an over-twister unit disposed between the direction change roll unit and the capstan roll unit to stabilize twisting of the cable during travelling between the direction change roll unit and the capstan roll unit; and a rear portion of the frame including a driving the flyer unit, the take-up unit, the direction change roll unit, the capstan roll unit and the over-twister unit.

3 Claims, 4 Drawing Figures

ARRANGEMENT OF STRAND TWISTING APPARATUSES

This invention relates to arrangement of strand twisting apparatuses and, more particularly, to arrangement of apparatuses for twisting strands into a cable.

In general, there have been known strand twisting apparatuses each of which comprises a flyer unit for supplying and twisting strands into a cable, a twist ratio adjusting unit for adjusting a twist ratio of the cable, a take-up unit for winding the cable, and a delivery unit disposed between the twist ratio adjusting unit and the take-up unit for smooth feed of the cable to the take-up unit, all units being located horizontally to travel the strands and the cable in a generally horizontal direction. Such a conventional horizontal type required a large amount of floor spaces since the flyer unit, the twist ratio adjusting unit, the take-up unit and the delivery unit are all arranged horizontally. Furthermore, it was time-consuming and troublesome to disassemble and assemble mechanical parts which faces floor for installation.

It is therefore an object of the present invention to provide arrangement of strand twisting apparatuses which makes it possible to reduce installation space.

It is another object of the present invention to provide arrangement of strand twisting apparatuses which facilitates to disassemble and assemble mechanical parts.

It is a further object of the present invention to provide arrangement of strand twisting apparatuses which provides attendant operators with a suitable height for easy operation.

The above objects will be attained by an arrangement of strand twisting apparatuses which comprises a plurality of strand twisting apparatuses which are side-by-side and vertically installed in a row on floor, and each of which comprises a fore portion of a frame including a flyer unit vertically disposed for supplying and twisting strands into a cable, a take-up unit disposed in side-by-side relation with the flyer unit to wind the cable, a direction change roll unit disposed immediately above the flyer unit for changing the cable vertically fed from the flyer unit to a horizontal direction, a capstan roll unit disposed immediately above the take-up unit for smooth feed of the cable fed from the direction change roll unit to the take-up unit, and an over-twister unit disposed between the direction change roll unit and the capstan roll unit to stabilize twisting of the cable during travelling between the direction change roll unit and the capstan roll unit; and a rear portion of the frame including a driving unit for driving the flyer unit, the take-up unit, the direction change roll unit, the capstan roll unit and the over-twister unit.

According to the other aspect of the present invention, a plurality of rows of strand twisting apparatuses may be spacedly arranged in such a manner that the fore portion of each frame is in opposing relation with a rear portion of each frame of adjacent another opposing row of strand twisting apparatuses. On the other hand, a plurality of rows of strand twisting apparatuses may be spacedly arranged in such a manner that the fore portion of each frame is in opposing relation with a fore portion of each frame of adjacent one opposing row of strand twisting apparatuses and that the rear portion of each frame is in opposing relation with a rear portion of each frame of adjacent remaining opposing row of strand twisting apparatuses.

The above and other objects, features and advantages of the present invention will become clear from the following particular description of the invention and the appended claims, taken in conjunction with the accompanying drawings which show by way of example a preferred embodiment of the present invention.

Figure 1:
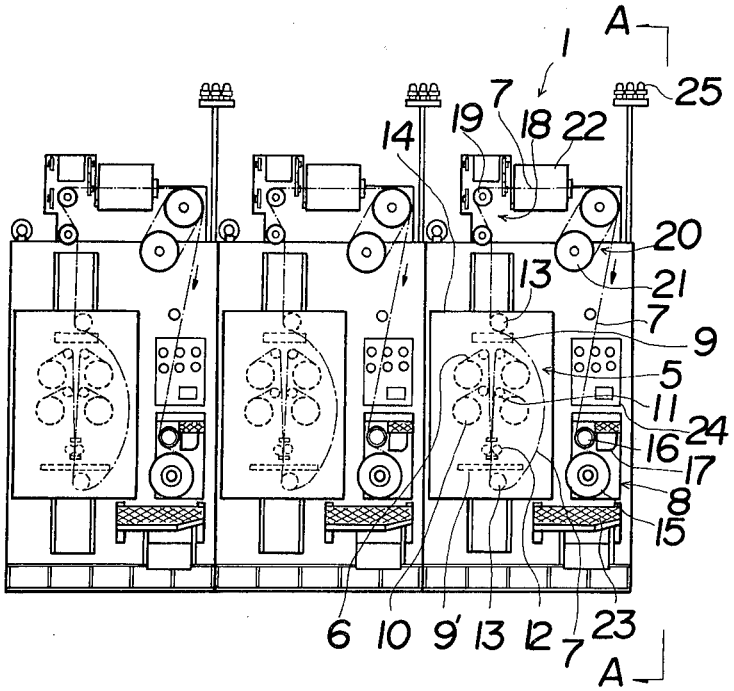
FIG. 1 is a front elevational view of strand twisting apparatuses arranged in accordance with the present invention.
Figure 2:
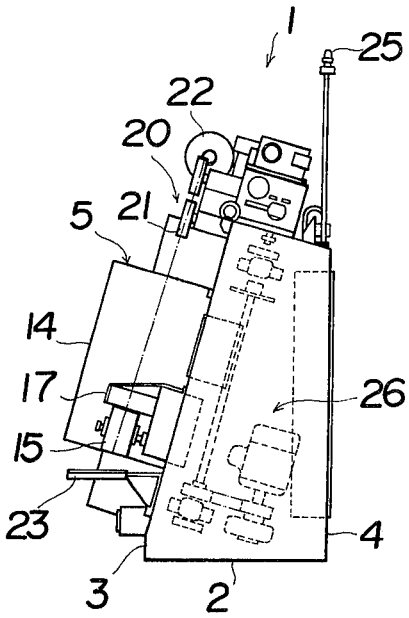
FIG. 2 is a side elevational view taken along the lines A—A in FIG. 1.

Referring now to the drawings and in particular to FIGS. 1 and 2, there is shown a strand twisting apparatus, generally indicated at 1, which comprises a frame 2 having a fore portion 3 and a rear portion 4. The fore portion 3 includes a flyer unit 5 vertically disposed for supplying and twisting strands 6 into a cable 7 in an usual manner, and a take-up unit 8 disposed in side-by-side relation with said flyer unit 5 to wind said cable 7. The flyer unit 5 is shown as comprising a pair of flyer arms 9 and 9', supply reels 10, guide rolls 11, tension rolls 12, and a pair of twisting rolls 13, all of which are covered by a covering member 14. The take-up unit 8 is shown as comprising a take-up reel 15, a guide roll 16 and a traversing mechanism 17. A direction change roll unit 18 comprises a pair of rolls 19 disposed immediately above the flyer unit 5 for changing the cable 7 vertically fed from the flyer unit 5 to a horizontal direction. A capstan roll unit 20 also comprises a pair of rolls 21 disposed immediately above the take-up unit 8 for smooth feed of the cable 7 to the take-up unit 8. Between the direction change unit 18 and the capstan roll unit 20 is located an over-twister unit 22 which is adapted to prevent the cable 7 from untwisting and stabilize the twisting of the cable 7 while the cable 7 is travelling between the direction change unit 18 and the capstan roll unit 20. Below the take-up unit 8 is provided a step 23 which is used for allowing an attendant operator to do a threading operation. Above the take-up unit 8 is provided an operation panel 24 for the attendant operator to operate the strand twisting apparatus 1. A warning tower lamp 25 is installed on the strand twisting apparatus 1 so as to make it possible for the operator to check its operation condition at a glance from remote places. On the other hand, the rear portion 4 of the frame 2 includes a driving unit 26 for driving the flyer unit 5, the take-up unit 8, the direction change roll unit 18, and the over-twister unit 22.

Figure 3:
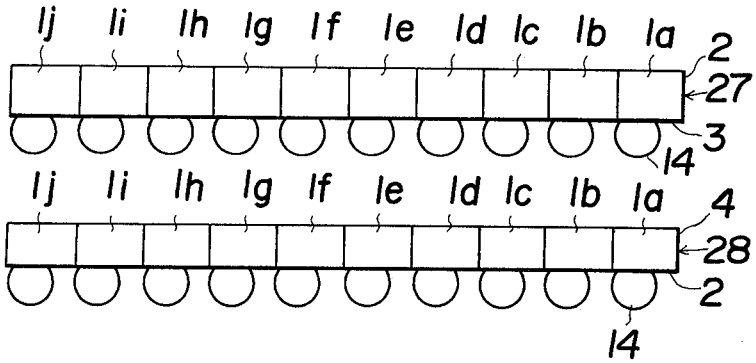
FIG. 3 is a plan view of strand twisting apparatuses arranged in accordance with one embodiment of the present invention.

FIG. 3 shows an arrangement of the strand twisting apparatuses 1 in which a plurality of rows 27 and 28 of strand twisiting apparatus 1*a* to 1*j* which rows 27 and 28 are spacedly arranged in such a manner that the fore portion 3 of each frame 2 of the row 27 is in opposing relation with a rear portion 4 of each frame 2 of adjacent another opposing row 28 of the strand twisting apparatuses 1*a* to 1*j*.

Figure 4:
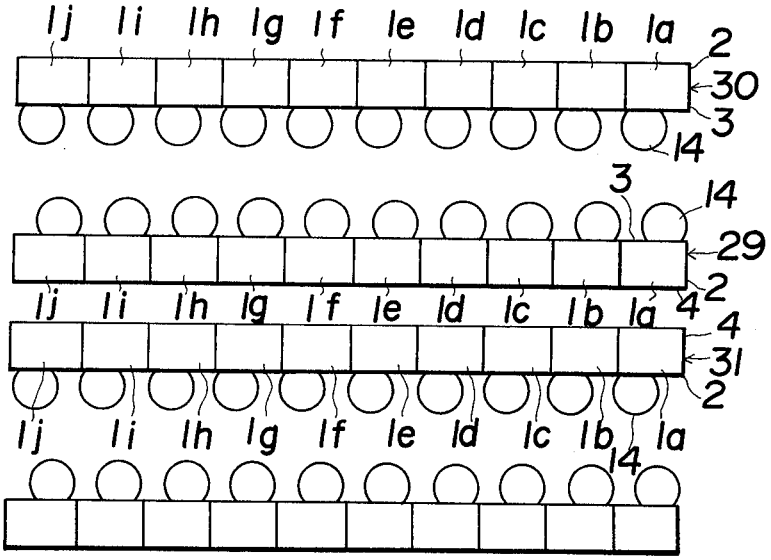
FIG. 4 is also a plan view of strand twisting apparatuses arranged in accordance with the other embodiment of the present invention.

FIG. 4 shows another arrangement of the strand twisting apparatuses 1 in which a plurality of rows 29 and 30 of strand twisting apparatuses 1*a* to 1*j* which rows 29, 30 and 31 are spacedly arranged in such a manner that the fore portion 3 of each frame 2 of the row 29 is in opposing relation with a fore portion 3 of each frame 2 of adjacent one opposing row 30 of strand twisting apparatuses 1*a* to 1*j* and that the rear portion 4 of each frame 2 is in opposing relation with a rear portion 4 of each frame 2 of adjacent remaining opposing row 31 of strand twisting apparatuses 1*a* to 1*j*. The spaces between the rows 27 and 28 and the rows 29, 30 and 31 may be preferably small enough to permit the operators and trucks for carrying reels to pass through between the rows 27 and 28 and the rows 29, 30 and 31.

According to the present invention, it will be understood that the vertical and side-by-side arrangement of strand twisting apparatuses in accordance with the present invention makes it possible to reduce installation space in comparison with the conventional horizontal arrangement of the strand twisting apparatuses. Moreover, the disassembling and assembling of the mechanical parts of the strand twisting apparatus can be easily effected since the apparatus enables the operator to approach both the fore and rear faces thereof. The arrangement of the strand twisting apparatuses according to the present invention can provide the operators with a suitable height for easy operation since the twisted cable is made turned at the direction change roll unit and the capstan roll unit.

Although particular embodiments of the present invention have been shown and described, it will be obvious to those skilled in the art that various changes and modifications may be made without departing from the spirit and scope of the present invention.

What is claimed is:

1. Arrangement of strand twisting apparatuses, comprising a plurality of strand twisting apparatuses which are side-by-side and vertically installed in a row on floor, and each of which comprises a fore portion of a frame including a flyer unit vertically disposed for supplying and twisting strands into a cable, a take-up unit disposed in side-by-side relation with said flyer unit to wind said cable, a direction change roll unit disposed immediately above said flyer unit for changing said cable vertically fed from said flyer unit to a horizontal direction, a capstan roll unit disposed immediately above said take-up unit for smooth feed of said cable fed from the direction change roll unit to said take-up unit, and an over-twister unit disposed between said direction change roll unit and said capstan roll unit to stabilize twisting of said cable during travelling between said direction change roll unit and said capstan roll unit; and a rear portion of said frame including a driving unit for driving said flyer unit, said take-up unit, said direction change roll unit, said capstan roll unit and said over-twister unit.

2. Arrangement of strand twisting apparatuses as set forth in claim 1, in which a plurality of rows of strand twisting apparatuses are spacedly arranged in such a manner that said fore portion of each frame is in opposing relation with a rear portion of each frame of adjacent another opposing row of strand twisting apparatuses.

3. Arrangement of strand twisting apparatuses as set forth in claim 1, in which a plurality of rows of strand twisting apparatuses are spacedly arranged in such a manner that said fore portion of each frame is in opposing relation with a fore portion of each frame of adjacent one opposing row of strand twisting apparatuses and that said rear portion of each frame is in opposing relation with a rear portion of each frame of adjacent remaining opposing row of strand twisting apparatuses.

* * * * *